United States Patent [19]

Jones

[11] Patent Number: 4,632,788

[45] Date of Patent: Dec. 30, 1986

[54] CARBURETOR FUEL FEED SYSTEM WITH BIDIRECTIONAL PASSAGE

[76] Inventor: James S. Jones, 45 Crown Pl., Richardson, Tex. 75080

[21] Appl. No.: 748,477

[22] Filed: Jun. 25, 1985

[51] Int. Cl.[4] ..... F02M 7/04

[52] U.S. Cl. ..... 261/41.5; 261/DIG. 78; 261/DIG. 39; 261/69.1; 261/69.2

[58] Field of Search ..... 261/41 D, 69 A, 69 R, 261/DIG. 78, DIG. 39

[56] References Cited

U.S. PATENT DOCUMENTS

| | | | |
|---|---|---|---|
| 1,857,889 | 5/1932 | Sturm | 261/41 D |
| 2,316,327 | 4/1943 | Garretson | 261/69 A |
| 2,372,306 | 3/1945 | Adair | 261/69 A |
| 2,507,075 | 5/1950 | Wiegand et al. | 261/69 A |
| 2,635,862 | 4/1953 | Stoltman | 261/41 D |
| 2,674,443 | 4/1954 | Bracke | 261/41 D |
| 2,680,605 | 6/1954 | Bracke | 261/69 A |
| 2,694,560 | 11/1954 | Olson | 261/41 D |
| 2,852,240 | 9/1958 | Goodyear | 261/41 D |
| 3,009,794 | 11/1961 | Barfod | 261/69 R |
| 3,067,020 | 12/1962 | Holzapfel | 261/69 A |
| 3,201,097 | 8/1965 | Arndt | 261/41 D |
| 3,409,276 | 11/1968 | Fuchs | 261/69 A |
| 3,779,529 | 12/1973 | Kimura | 261/69 A |
| 4,329,964 | 5/1982 | Morris | 261/41 D |
| 4,387,063 | 6/1983 | Pontoppidan | 261/41 D |

*Primary Examiner*—Tim Miles

*Attorney, Agent, or Firm*—Richards, Harris, Medlock & Andrews

[57] ABSTRACT

An improved carburetor is provided wherein a bidirectional passage is provided between an air velocity reader and a location downstream of a throttle. Metered fuel flows into the bidirectional passage adjacent the air velocity reader. Flow direction in the bidirectional passage is dependent on the pressure relationship between the ends of the bidirectional passage.

12 Claims, 9 Drawing Figures

FIG. 4
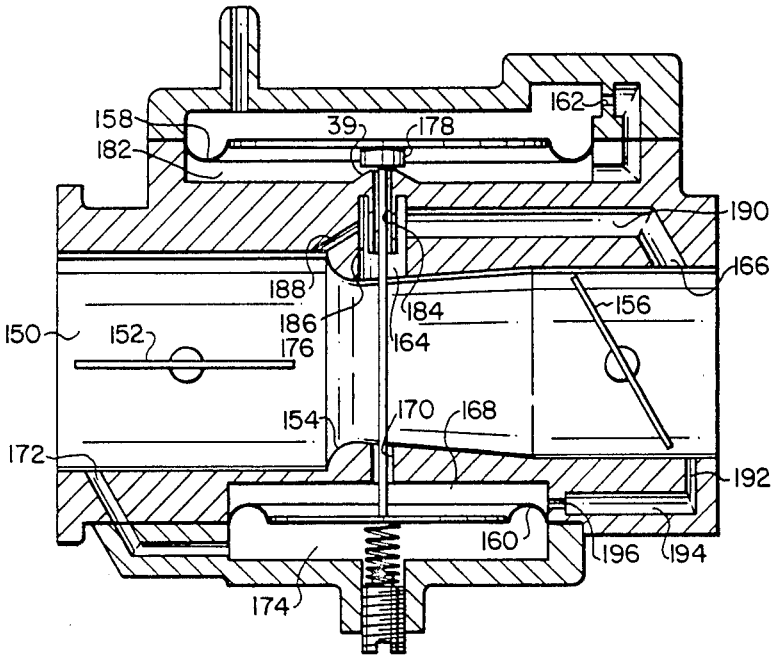
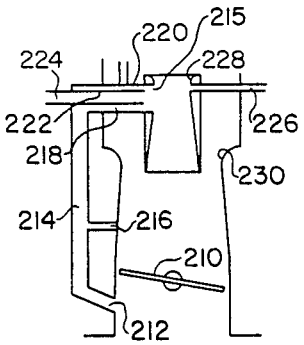
FIG. 5
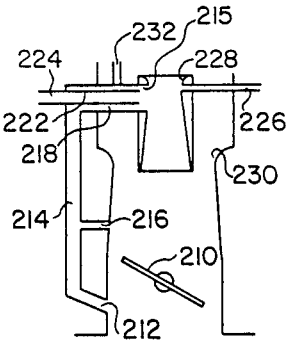
FIG. 6
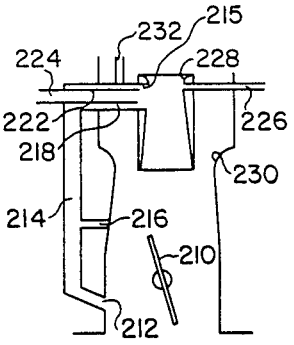
FIG. 7

CARBURETOR FUEL FEED SYSTEM WITH BIDIRECTIONAL PASSAGEcl TECHNICAL FIELD

This invention relates to air/fuel systems for internal combustion engines and more specifically to systems where the fuel is liquid at ambient conditions.

BACKGROUND ART

The conventional gasoline carburetor uses a float to maintain a liquid level in a reservoir slightly below the discharge of the fuel nozzle. Means must be provided to lift the fuel and break the fuel's surface tension before any fuel can be fed into the main air stream on the ambient side of the throttle valve. A main fuel jet is provided to feed an accelerating well or an emulsion chamber. To compensate for a weak fuel supply at low air flows, the jet is sized more largely than theoretically would be required. The air signal is then progressively weakened with air bleeds as the air flow increases.

The float type carburetor is a blending of several different systems. The slow speed idle system uses manifold vacuum to lift fuel from the accelerating well and is the predominant system at idle, but as the throttle is opened an idle progression system supports the idle system. Then as the throttle is opened further, the fuel nozzle begins to feed into the main air stream on the ambient side of the throttle plate. As the air demand increases, the idle and progression systems become less predominant and at maximum power the idle system is phased out completely. Since all of the fuel flows through the main fuel jet, the pressure difference across it is less than the air signal, but is directly related to it.

The blending of the systems for the updraft carburetor is closely related to specific engine and manifolding. The feeding of fuel through the fuel nozzle cannot begin until the air velocity is great enough to lift the fuel and keep it in suspension until it crosses the throttle valve; therefore, it becomes a trade-off of air capacity against the proper operation of the low speed, low load operation.

SUMMARY OF THE INVENTION

This invention provides a carburetor having means for mixing metered liquid fuel in a confined area where the area has free communication with the main air passage both on the engine side through a bidirectional passage and on the ambient side of the throttle plate. The invention provides an air/liquid fuel system where the liquid fuel meets an air stream having the highest possible velocity in all operating modes.

The invention is intended to be used with conventional fuel pumps (in the 4 to 8 PSIG range). The improved carburetor has an unrestricted fuel path to the air stream, and the fuel pump pressure is used only to provide the required pressure difference across the metering orifices and the throttling valve, with the exception of systems used for small engines not equipped with fuel pumps.

BRIEF DESCRIPTION OF THE DRAWINGS

FIG. 4 is a partially broken away side view of a side draft carburetor incorporating the present invention and usable with engines operating without fuel pumps.

FIGS. 5, 6 and 7 are schematic views illustrating operation of the fuel feed system of the present invention at different throttle settings.

DETAILED DESCRIPTION

Figure 1:
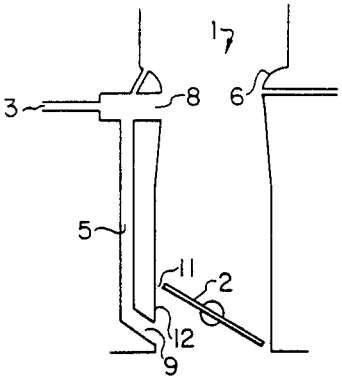
FIG. 1 is a schematic view illustrating a single venturi carburetor having the fuel feed system of the present invention.

Referring initally to FIG. 1, a carburetor for use on small engines where the speed range is low, such as air cooled one and two cylinder engines, is illustrated. The carburetor has an air inlet 1, a throttle valve 2, a fuel inlet 3, a bidirectional passage 5, a primary venturi 6, and an air entrance 8. At engine loads where the vacuum is higher at discharge 9 than at air entrance 8, the fuel is gasified and mixed with air in bidirectional passage 5. Bidirectional passage 5 ends at discharge 9, where the air/fuel mixture meets and mixes with air passing through the throttle opening 11 formed by throttle valve 2 and throttle bore 12. At engine loads where the vacuum at primary venturi 6 is greater than at discharge 9, fuel from inlet 3 meets air flowing away from discharge 9 by way of bidirectional passage 5 and moves into the main air stream in venturi 6 by way of entrance 8.

Figure 2:
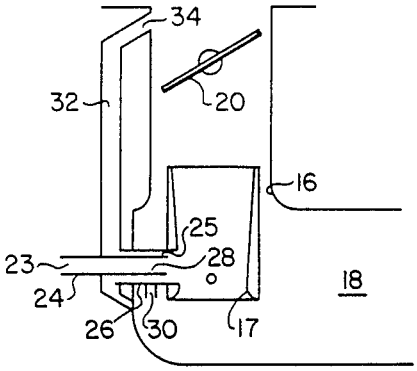
FIG. 2 is a schematic view illustrating the carburetor of the present invention having primary and secondary venturis.

FIG. 2 shows an updraft carburetor utilizing both a primary venturi 16 and a secondary venturi 17. The carburetor illustrated in FIG. 2 has an air inlet 18, a throttle valve 20, and a fuel inlet 23 having a first tubular section 24 extending through and defining confined area 25 within a second tubular section 26. Second tubular section 26 communicates with entrance 28, auxiliary air passage 30, and bidirectional passage 32. At idle, metered liquid fuel from inlet 23 meets with air in confined area 25 at the end of first tubular section 24. Some of the air required for the idle mode enters second tubular section 26 from entrance 28 and having a high velocity, picks up the metered fuel in confined area 25 on its way to the bidirectional passage 32. The air/fuel mixture in confined area 25 meets with air from auxiliary passage 30 and is discharged between the engine and the throttle valve 20 at a very high velocity at discharge 34 by way of bidirectional passage 32. As the engine's load and speed is increased by opening throttle valve 20, additional air is allowed to flow to the engine and more metered fuel is required at fuel inlet 23. The fuel's path is the same as in the idle mode and meets the additional air between the engine and the throttle valve at discharge 34. At the maximum load, the vacuum at entrance 28 becomes greater than the vacuum at discharge 34, so there is a reversed flow of air from said discharge 34 through bidirectional passage 32. This air is met in confined area 25 with air from auxiliary air passage 30, picks up the metered fuel at the end of tubular section 24 and enters the main air stream at entrance 28.

Figure 3:
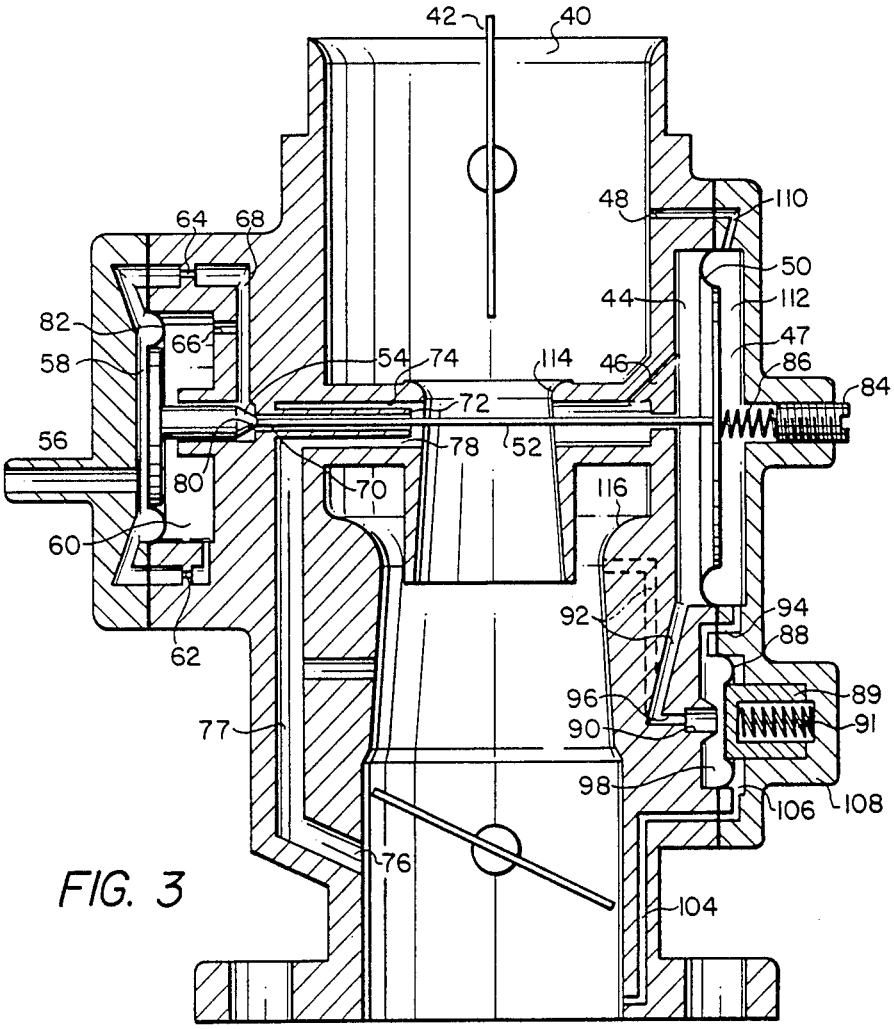
FIG. 3 is a partially broken away side view of a downdraft carburetor using the fuel feed system of the present invention.

FIG. 3 illustrates a carburetor having an air inlet 40 and a conventional choke valve 42. Choke valve 42 is closed for the cold start mode allowing the engine's demand for air to evacuate air reader chamber 44 by way of the air signal passage 46. Ambient air chamber 47 is filled by way of vent passage 48 which is always on the ambient side of choke valve 42. The inward movement of air diaphragm 50 acts on valve pin 52 to open fuel valve 54. Fuel valve 54 allows liquid fuel from inlet 56 at normal fuel pump pressure to fill unmetered fuel chamber 58 and also fill metered fuel chamber 60 by way of metering orifice 62. Metered fuel from orifice 62 moves upward through metered fuel chamber 60 and through passage 66 into fuel passage 68, which eliminates accumulation of vapors in chamber 60. The fuel passing through metering orifice 64 eliminates the accumulation of vapors in chamber 58. The metered fuel from fuel passage 68 passes across fuel valve 54, enters metered fuel inlet 70 then meets with air at the end of tubular section 72 in confined area 74. The air/fuel mixture then passes into the main air stream at either discharge 76, after passing through bidirectional passage 77, or entrance 78.

Once the engine has started and choke valve 42 is fully opened, the fuel is throttled by valve 54 against its seat 80 to allow a fuel flow across fuel orifices 62 and 64. At all operating modes, the pressure difference across orifices 62 and 64 is read by fuel diaphragm 82 and acting through valve pin 52, offsets the inward force of air diaphragm 50 created by the movement of air to the engine. A trim screw 84 is provided to load spring 86 acting against valve 54 and to offset the closing effect of the fuel diaphragm 82. Trim screw 84 also acts as an idle trim. The relative sizes of diaphragms 50 and 82 is not critical.

The air/fuel requirement for maximum power is 10% surplus fuel, and the air/fuel requirement for maximum efficiency is 10% surplus air. To provide for these different ratios a vacuum responsive diaphragm 88 is attached to a piston 89 which is normally at rest on seat 90 due to the bias of spring 91, closing the venturi signal from passages 92 and 94 through orifice 96 and chamber 98. Engine vacuum acting through passage 104 evacuates chamber 106 until piston 89 comes to rest against cover 108. Movement of piston 89 away from seat 90 opens communication with either the primary or secondary venturi signal at passages 92 and 94 through orifice 96 causing a flow of air from inlet 40 through passage 48 across orifice 110. Orifices 96 and 110 are so sized to provide a partial vacuum in chamber 47 to provide leaner air/fuel ratios for the light load modes. The air signal for orifice 96 is not critical and can be picked up at any point in the air stream having a greater air velocity than at inlet 40. The sizing of orifices 96 and 110 would be required to properly reduce the air signal across air diaphragm 50.

In operation, the control of the fuel is provided by the pressure signal due to the air velocity through the secondary venturi 114 read by the air diaphragm 50. The pressure signal read by air diaphragm 50 is used to open fuel valve 54 allowing a fuel velocity across fuel orifices 62 and 64. The fuel velocity is read by fuel diaphragm 82 which acts to close fuel valve 54. The forces on the air and fuel diaphragms oppose one another in equilibrium to properly position the fuel valve 54. The fuel velocity is amplified by using a smaller fuel diaphragm 82 than the air diaphragm 50.

The fuel requirement for slow speed idle is 10% to 20% richer than at maximum power. This is due to inadequate purging of the combustion chamber. A good portion of the air requirement for idle is fed into entrance 78 and is a constant quantity until the velocity in confined area 74 becomes subsonic. The air signal to air diaphragm 50 is provided by the air velocity in the secondary venturi 114. The movement of air through the bidirectional passage 77 reduces the air velocity in the primary venturi 116 but increases the air velocity in the secondary venturi 114 for a given quantity of air. This increased air signal provides the additional fuel for the slow idle mode.

The pressure of the fuel pump acts to close valve 54 and provides a means to trim the idle with spring 86 as adjusted with screw 84. If the air signal is inadequate, more spring load is applied, and vice versa. This additional idle fuel rapidly decreases as the air flow increases.

FIG. 4 illustrates a side draft carburetor for use on small engines equipped either with or without fuel pumps. The carburetor has air inlet 150, a choke 152 required for cold starting, a simple primary venturi 154, and a throttle valve 156. To accomodate engines without fuel pumps, fuel diaphragm 158 would be sized larger than air diaphragm 160. The relative sizing of venturi 154 and metering orifice 162 is related to the areas of diaphragms 150 and 160. With fuel diaphragm 150 being larger than air diaphragm 160, the fuel metering orifice 162 would be larger than required for a conventional carburetor having an equal venturi size. The venturi pressure depression at entrance 164 and vacuum at discharge 166 provide the required pressure difference across liquid fuel metering orifice 162 at the heavier fuel demands. The pressure depression of venturi 154 is read in chamber 168 by way of air signal pick up 170, which allows free air from inlet 150 through passage 172 into chamber 174 to move air diaphragm 160 upward. Air diaphragm 160 pushes fuel valve pin 176 to unseat valve 178 from seat 180 allowing metered fuel from chamber 182 to enter fuel inlet 184. This flow of fuel causes a pressure drop across orifice 162 which is read by fuel diaphragm 158 and acts through valve 178 and pin 176 to bring about a balance of forces between diaphragms 160 and 158 providing the proper fuel charge. At the extreme heavier loads metered fuel at inlet 184 is met with air in confined area 186 from auxiliary air feed 188 and back flow from discharge 166 by way of bidirectional passage 190. The additional air is fed into the main air stream at entrance 164. At lesser loads the vacuum at discharge 166 is greater than the pressure depression at entrance 164 so the fuel from inlet 184 is met with air from entrance 164 and auxiliary air feed 188 in the confined area 186 and discharged through discharge 166 by way of bidirectional passage 190. At heavier loads where the fuel is fed through entrance 164, there will be a slight accumulation of liquid in chamber 168 so an evacuating system is provided using manifold vacuum acting through opening 192, passage 194 and orifice 196.

FIG. 5 illustrates operation of the carburetor in the idle mode. The throttle valve 210 is closed to its idle position passing a small portion of the idle air. As shown by the arrows, a large portion of the idle air is fed with the idle fuel through discharge 212 by way of bidirectional passage 214 and auxiliary air feed 216. The air entering bidirectional passage 214 by way of entrance 215 in confined area 218, formed by first and second tubular sections 220 and 222, picks up metered fuel flowing through fuel inlet 224 and accelerates it to a sonic velocity so all of the fuel leaving through discharge 212 is in the gas phase providing a very good condition for air/fuel blending and distribution.

The fuel flow through fuel inlet 224 is metered by metering means (not shown) acting in response to an air signal in reader 226. The air signal in reader 226 is a function of the air velocity in the secondary venturi 228. This arrangement produces a much stronger signal at reader 226 than an arrangement where all of the air is fed across the air throttle valve 210.

FIG. 6 uses the same reference numerals as used above in connection with FIG. 5. FIG. 6 illustrates the carburetor of FIG. 5 where throttle valve 210 is partially open, which can represent operational modes between maximum load at low RPM to very high RPM with a light load. It is possible to have a condition where the absolute pressures at entrance 215 and discharge 212 are equal, but the absolute pressures at auxiliary air feeds 216 and 232 are always greater than the absolute pressure at entrance 215. Therefore, there can never be a stalled condition in the confined area 218, only a change of direction of fuel flow.

FIG. 7 uses the same reference numerals as FIGS. 5 and 6, and shows throttle valve 210 fully opened which represents maximum power at all speeds. The absolute pressure at auxiliary air feed 232, auxiliary air feed 216 and discharge 212 will be greater than the absolute pressure at entrance 215. Air will be flowing into auxiliary air feed 232 and, as shown by the arrows, an air/fuel blend will be flowing into auxiliary air feed 216 and discharge 212 and will meet with the metered fuel from inlet 224 at the end of first tubular section 220. The air and air/fuel blend flows into the main air path from the confined area 218 and feeds the fuel into the air stream at the point of highest air velocity.

Figure 8:
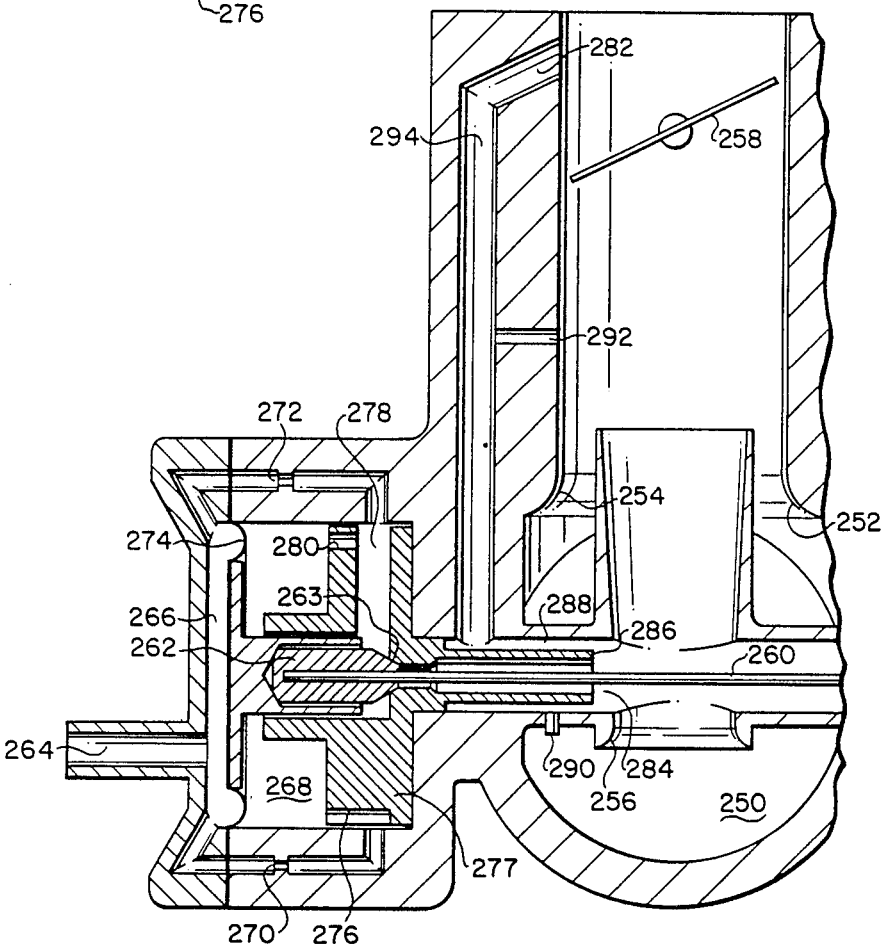
FIG. 8 is an enlarged partially broken away side view of the fuel feed system.

FIG. 8 shows in more detail the fuel and air legs of an updraft carburetor constructed in accordance with the invention. The carburetor has air inlet 250 with a primary venturi 252. Primary venturi 252 is cylindrical in shape with a rounded air entrance 254. Secondary venturi 256 extends into the bore just past the rounded entrance 254. Air throttle valve 258 is located downstream of the primary venturi 252. The air velocity at primary venturi 252 is amplified by secondary venturi 256. The air velocity signal is used to provide a force on valve pin 260 to unseat fuel valve 262 and allow fuel to flow from inlet 264 into unmetered chamber 266 and on into metered chamber 268 by way of fuel orifices 270 and 272. The fuel velocity across fuel orifices 270 and 272 is read by fuel diaphragm 274 which acts to close fuel valve 262, and therefore positions valve 262 to provide a fuel velocity across the fuel orifices that is always related to the air velocity across secondary venturi 256. The metered fuel across orifice 272 purges the unmetered fuel chamber 266 of any gas or vapor. The metered fuel through orifice 270 enters the bottom of chamber 268 through cut-out 276 in fuel valve housing 277 and flows upward and into passage 278 by way of passage 280 in fuel valve housing 277.

In operation, at all operating modes other than maximum load the absolute pressure is lower at discharge 282 than the absolute pressure at entrance 284. Metered fuel flows from the end of tube 286, where it meets air entering the confined area 288 and additional air through auxiliary air orifices 290 and 292 on its way to discharge 282 by way of bidirectional passage 294. A sudden mode change from idle to maximum power reverses the flow of the air/fuel blend through bidirectional passage 294. In the maximum power mode, an air/fuel blend from discharge 282 and auxiliary air orifice 292 meets with air from auxiliary air orifice 290 as it crosses the confined area 288. The air/fuel blend then meets the metered fuel at the end of tube 286 just prior to entering the main air path at entrance 284.

It is possible to have the air throttle valve 258 so positioned that the absolute air pressure would be equal at entrance 284 and discharge 282; however, the absolute air pressure at auxiliary air orifices 290 and 292 is always greater. During the maximum power mode the air velocity through auxiliary air orifices 290 and 292 is always related to engine speed. Therefore, sizing auxiliary air orifices 290 and 292 to purge bidirectional passage 294 several times for each power pulse of the engine assures the meeting of the fuel and air.

Figure 9:
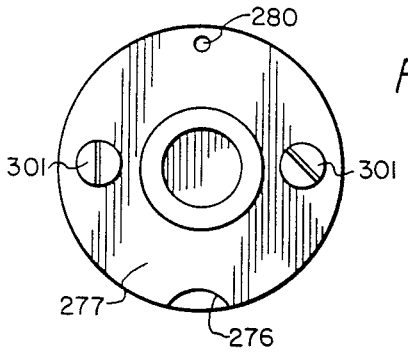
FIG. 9 is a front view of a fuel valve housing of the fuel feed system of FIG. 8.

FIG. 9 shows the fuel valve housing 277 so mounted with screws 301 to be rotated 180° allowing reversal of cut-out 276 and passage 280 when the carburetor is converted from an updraft to a downdraft system.

In operation, the fuel feed system of the present invention offers numerous advantages over the prior art. The fuel feed system is not critically related to air leg sizing, especially when used in connection with updraft units. Fuel is fed on the ambient side of the throttle valve only at maximum engine loads, whereas the conventional carburetor feeds fuel on the ambient side of the throttle at all but very light engine loads. Air demand at idle at any RPM is approximately one-third the air requirement at maximum load. Because the air signal at the venturi increases to the second power of the velocity, the air signal increase nine times at maximum load, and then this signal is further amplified by two at the secondary venturi providing a force increase of eighteen to pick up and suspend the fuel as compared to the conventional gasoline carburetor.

The invention eliminates the need for fuel surplusage at low speed, light load operations required by the conventional carburetor because of inadequate air/fuel blending and distribution. The air meets the fuel at a sonic velocity in the confined area where the fuel is thoroughly mixed and vaporized. Fuel in its gas phase is mixed with air as it enters the engine manifold at the discharge of the bidirectional passage, providing ideal conditions for blending and distribution.

The invention provides a linear air/fuel ratio for all maximum power modes. There is a shift of the air/fuel ratio for loads less than 80% of maximum load which is also linear and is supplied by a restricting orifice (orifice 110 in FIG. 3) having communication with free air on one side and the ambient side of the air diaphragm on the other side. The restricting orifice works in connection with another orifice (orifice 96 in FIG. 3) having communication with one of either venturis and the ambient side of the air diaphragm. The air flow through the ambient side of the diaphragm chamber causes a negative air signal on the ambient side of the air diaphragm that reduces the effective air signal of the air diaphragm. Placed between the orifice having communication with either venturi and the ambient side of the air diaphragm is an on/off valve (piston 89 in FIG. 3) responsive to manifold vacuum that opens this communication at manifold vacuums greater than 4–5 inches Hg. The on/off valve provides a leaner mixture at the lighter engine loads.

No pressure balance can exist between the opening in the bidirectional passage at the venturi and the fuel discharge of the bidirectional passage downstream of the throttle valve. A pressure balance in the bidirectional passage would disrupt the feeding of fuel. The auxiliary air passage or passages communicate with the bidirectional passage on either side or both sides of the venturi throat but upstream of the throttle valve.

A vapor-free liquid head is maintained on both sides of the fuel diaphragm by isolating the metered fuel except for a passage (passage 280 in FIGS. 8 and 9) at the very top of the chamber and by flowing a portion of the metered fuel from the bottom of the chamber (cutout 276 in FIGS. 8 and 9). Any vapor that is formed flows through the passage at the top and on through to the metering valve.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. In a carburetor having an air inlet, an outlet, throttling means for controlling the flow through a main air path, and a venturi for reading air velocity through the carburetor located between the throttling means and the air inlet, the improvement comprising a bidirectional passage between the venturi and an area downstream of the throttling means for allowing free movement of air either from the venturi to the area downstream of the throttling means or from the area downstream of the throttling means to the venturi, the direction of air movement being dependent on the pressure relationship between the venturi and the area downstream of the throttling means, and having means for receiving metered fuel into the bidirectional passage and allowing metered fuel to blend with air moving through the bidirectional passage and meet with the main air path either at the area downstream of the throttling means or at the venturi, wherein the means for receiving metered fuel comprises a tubular section extending into the bidirectional passage adjacent the venturi and providing a confined area of high velocity where fuel meets with air when the flow is from the venturi to the area downstream of the throttling means.

2. The carburetor of claim 1 further comprising an auxiliary air feed providing communication between the confined area and the main air path.

3. A carburetor comprising an inlet, an outlet, throttle means for controlling the flow through a main air path, a primary venturi and primary venturi amplifying means between the inlet and the throttle means, the primary venturi amplifying means being a secondary venturi upstream of, but extending into the throat of the primary venturi, a bidirectional passage between the primary venturi amplifying means and an area between the throttling means and the outlet, and means for receiving metered fuel comprising a tubular section extending into said bidirectional passage adjacent the primary venturi amplifying means and defining a confined area of high velocity within the bidirectional passage where fuel meets with air when the flow is in the direction from the primary venturi amplifying means to the area below the throttling means.

4. The carburetor of claim 3 further comprising means for allowing communication between the main air path, at a location between the primary venturi and the throttle means, and the bidirectional passage.

5. The carburetor of claim 4 further comprising means for allowing communication between an area in the main air path upstream of or adjacent to the primary venturi amplifying means and the confined area.

6. The carburetor of claim 3 further comprising means for allowing communication between an area in the main air path upstream of or adjacent to the primary venturi amplifying means and the confined area.

7. The carburetor of claim 6 further comprising means for metering fuel using an air velocity signal from the secondary venturi, the air velocity signal causing liquid fuel to flow from a fuel inlet across at least one metering orifice through a fuel valve into the tubular section, with the air velocity signal being read by an air diaphragm and the velocity across the fuel orifices being read by a fuel diaphragm, with the air and fuel diaphragms opposing one another and connected to the fuel valve, and with the air diaphragm acting to open the fuel valve and the fuel diaphragm acting to close the fuel valve to so position the fuel valve as to provide substantially linear air/fuel flow.

8. The carburetor of claim 7 further comprising means for allowing communication between an area in the main air path upstream of or adjacent to the primary venture amplifying means and the confined area.

9. The carburetor of claim 8 further comprising an adjustable spring means for aiding the air diaphragm signal in balancing the fuel diaphragm signal and for providing an idle fuel trim.

10. The carburetor of claim 9 further comprising first and second fuel metering orifices, the first fuel metering orifice receiving fuel from the upper portion of the unmetered side of the fuel diaphragm chamber and being located such that flow therethrough to the fuel valve is isolated from the metered side of the fuel diaphragm chamber, but the first fuel metering orifice having communication with the upper portion of the metered side of the fuel diaphragm chamber through a fuel isolating passage, the fuel isolating passage allowing metered fuel to flow from the bottom portion of the unmetered side of the fuel diaphragm chamber across the second fuel metering orifice into the lower portion of the metered side of the fuel diaphragm chamber and upward to join the metered fuel from the first fuel metering orifice through the fuel isolating passage on its way to the fuel valve, thereby purging both the metered and unmetered sides of the fuel diaphragm chambers.

11. The carburetor of claim 10 further comprising a fuel valve housing containing the fuel isolating passage and being mounted as to be rotated 180°, such that the carburetor may be used in an updraft or downdraft position.

12. The carburetor of claim 10 further comprising means for allowing the flow of air through the ambient air diaphragm chamber at a velocity related to the air velocity in the main air path such that the effective air velocity signal of the air diaphragm is reduced to provide a leaner air/fuel ratio at light engine loads and manifold vacuum responsive means for stopping the flow of air through the ambient air diaphragm chamber at engine loads greater than approximately 80% of maximum load.

* * * * *